US010858897B2

(12) United States Patent
Dell et al.

(10) Patent No.: US 10,858,897 B2
(45) Date of Patent: Dec. 8, 2020

(54) DOWNHOLE ARMORED OPTICAL CABLE TENSION MEASUREMENT

(71) Applicant: Halliburton Energy Services, Inc., Houston, TX (US)

(72) Inventors: Dustin Myron Dell, Duncan, OK (US); Bryan John Lewis, Duncan, OK (US); Robert Anthony Drexl, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 269 days.

(21) Appl. No.: 15/780,224

(22) PCT Filed: Jan. 27, 2016

(86) PCT No.: PCT/US2016/015094
§ 371 (c)(1),
(2) Date: May 30, 2018

(87) PCT Pub. No.: WO2017/131660
PCT Pub. Date: Aug. 3, 2017

(65) Prior Publication Data
US 2018/0363391 A1 Dec. 20, 2018

(51) Int. Cl.
*E21B 17/20* (2006.01)
*E21B 47/01* (2012.01)

(52) U.S. Cl.
CPC ..... *E21B 17/206* (2013.01); *E21B 47/01* (2013.01)

(58) Field of Classification Search
CPC .... E21B 17/206; E21B 47/00; E21B 47/0006; E21B 47/01; E21B 47/011; E21B 17/013
See application file for complete search history.

(56) References Cited

U.S. PATENT DOCUMENTS 4,265,110 A 5/1981 Moulin
4,267,727 A 5/1981 Hoppe
(Continued)

FOREIGN PATENT DOCUMENTS

CN 201924912 U 8/2011
EP 0884451 A2 12/1998
(Continued)

OTHER PUBLICATIONS

Korean Intellectual Property Office, PCT/US2016/015094, International Search Report and Written Opinion, dated Oct. 25, 2016, 15 pages, Korea.
(Continued)

*Primary Examiner* — Justin N Olamit

(57) ABSTRACT

A coiled tubing apparatus is described for use in wellbore operations. The apparatus includes a coiled tubing strand that may be deployed into a wellbore to convey a tool to a subterranean location. A signal cable extends through the coiled tubing strand to facilitate communication between a data acquisition unit at a surface location and the subterranean tool. Upper and lower detector elements are operably associated with the signal cable to detect forces applied to the signal cable at lower and upper ends of the signal cable. The operator may employ forces to adopt corrective measures to ensure the signal cable does not become damaged or loose communication with either the downhole tool or the data acquisition unit. Since the coiled tubing strand and the signal cable may experience elongation at different rates, forces are applied to the signal cable that could jeopardize the wellbore operation if not managed.

20 Claims, 6 Drawing Sheets

(56) References Cited

U.S. PATENT DOCUMENTS

| | | | | |
|---|---|---|---|---|
| 4,269,063 | A | 5/1981 | Escaron et al. | |
| 4,409,824 | A | 10/1983 | Salama et al. | |
| 4,811,597 | A | 3/1989 | Hebel | |
| 5,285,204 | A | 2/1994 | Sas-Jaworsky | |
| 5,828,003 | A | 10/1998 | Thomeer et al. | |
| 6,332,499 | B1 | 12/2001 | Kobylinski et al. | |
| 6,450,022 | B1 | 9/2002 | Brewer | |
| 6,662,645 | B2 * | 12/2003 | Brewer | E21B 47/0006 73/152.48 |
| 7,617,873 | B2 * | 11/2009 | Lovell | E21B 47/123 166/305.1 |
| 8,024,957 | B2 | 9/2011 | McKee | |
| 8,789,585 | B2 * | 7/2014 | Leising | E21B 47/00 166/250.01 |
| 8,939,039 | B2 | 1/2015 | Ratcliffe et al. | |
| 2005/0263281 | A1 | 12/2005 | Lovell et al. | |
| 2010/0096144 | A1 | 4/2010 | Mack | |
| 2011/0140907 | A1 | 1/2011 | Louden | |
| 2012/0085531 | A1 | 4/2012 | Leising et al. | |
| 2013/0284434 | A1 | 10/2013 | Marvel | |
| 2014/0327443 | A1 | 11/2014 | Liu et al. | |

FOREIGN PATENT DOCUMENTS

| | | | |
|---|---|---|---|
| GB | 2265684 | A | 6/1993 |
| WO | WO-2003067018 | A2 | 8/2003 |
| WO | WO-2004020776 | A2 | 3/2004 |
| WO | WO 2015/178935 | A1 | 11/2015 |

OTHER PUBLICATIONS

Netherlands Patent Office, NL1042187, Search Report and Written Opinion, dated May 26, 2017, 12 pages, Netherlands.

Netherlands Patent Office, NL1042498, Search Report and Written Opinion, dated Feb. 12, 2018, 8 pages, Netherlands.

Search Report issued for French Patent Application No. 1663274 dated Jul. 19, 2019, 11 pages.

* cited by examiner

DOWNHOLE ARMORED OPTICAL CABLE TENSION MEASUREMENT

CROSS-REFERENCE TO RELATED APPLICATION

This application is a U.S. national stage patent application of International Patent Application No. PCT/US2016/015094, filed on Jan. 27, 2016 the benefit of which is claimed and the disclosure of which is incorporated herein by reference in its entirety.

BACKGROUND

1. Field of the Invention

The present disclosure relates generally to monitoring equipment useful in operations related to subterranean wellbores, e.g., wellbores employed for oil and gas exploration, drilling and production. More particularly, embodiments of the disclosure relate to real-time monitoring of a signal cable that extends through a coiled tubing strand to ensure uninterrupted communication through the cable is maintained.

2. Background

In operations related to the production of hydrocarbons from subterranean geologic formations, coiled tubing is often employed to facilitate wellbore drilling, maintenance, treatment, stimulation and other wellbore processes. Coiled tubing generally includes a continuous strand of a flexible tube that may be wound and unwound from a spool. The length of a coiled tubing strand may be in the range of about 10,000 feet to about 25,000 feet in some instances, and thus, the coiled tubing strand may be unwound from a spool to readily lower a downhole tool to a subterranean location at a significant depth in a wellbore. Often, a signal cable may be provided through the coiled tubing strand to enable communication with the downhole tool. Downhole tools, e.g., well logging tools, may use the signal cable to transmit data to the surface location, and/or the signal cable may be used to transmit instructions and electrical power to the downhole tool.

In a typical coiled tubing operation, the downhole tool is coupled to a lower end of the coiled tubing strand while the coiled tubing string is wound around a spool. The process of attaching the downhole tool to the coiled tubing strand and establishing the necessary connections, e.g., to the signal cable, may be referred to as "rigging up." The rigging up process may be performed on a well platform or other job site exposing various electronic connectors to contamination. Once the downhole tool is connected, the coiled tubing strand is unwound from the spool and straightened as it is urged into the wellbore with a coiled tubing injector. The coiled tubing strand undergoes significant stresses as it is deployed into the wellbore, and these stresses may result in plastic deformation. The downhole tool performs its intended function within the wellbore and the coiled tubing injector is then used to withdraw the coiled tubing strand from the wellbore. The coiled tubing strand is rewound onto the spool for subsequent use.

The signal cable within the coiled tubing strand may not experience the same stresses or plastic deformation as the coiled tubing strand. These differences may result in the application of a tensile force that could break the cable or disconnect the cable from the downhole tool or surface equipment. Monitoring the forces applied to the signal cable in operation may permit corrective actions to be taken before a failure in the signal cable occurs.

BRIEF DESCRIPTION OF THE DRAWINGS

The disclosure is described in detail hereinafter on the basis of embodiments represented in the accompanying figures, in which.

DETAILED DESCRIPTION

In the following description, even though a figure may depict an apparatus in a portion of a wellbore having a specific orientation, unless indicated otherwise, it should be understood by those skilled in the art that the apparatus according to the present disclosure may be equally well suited for use in wellbore portions having other orientations including vertical, slanted, horizontal, curved, etc. Likewise, unless otherwise noted, even though a figure may depict an offshore operation, it should be understood by those skilled in the art that the apparatus according to the present disclosure is equally well suited for use in onshore or terrestrial operations. Further, unless otherwise noted, even though a figure may depict a wellbore that is cased, it should be understood by those skilled in the art that the apparatus according to the present disclosure may be equally well suited for use in slotted liner or fully open-hole wellbores.

1. Description of Exemplary Embodiments

The present disclosure includes a data acquisition system for monitoring forces applied to a signal cable in a coiled tubing apparatus. The data acquisition system may receive data from both upper and lower detector elements that that measure forces applied to the signal cable, and communicate this information to a user in real time. Based on the real time information, the operator may employ corrective measures to ensure the signal cable does not become damaged or loose communication during a wellbore operation.

Figure 1:
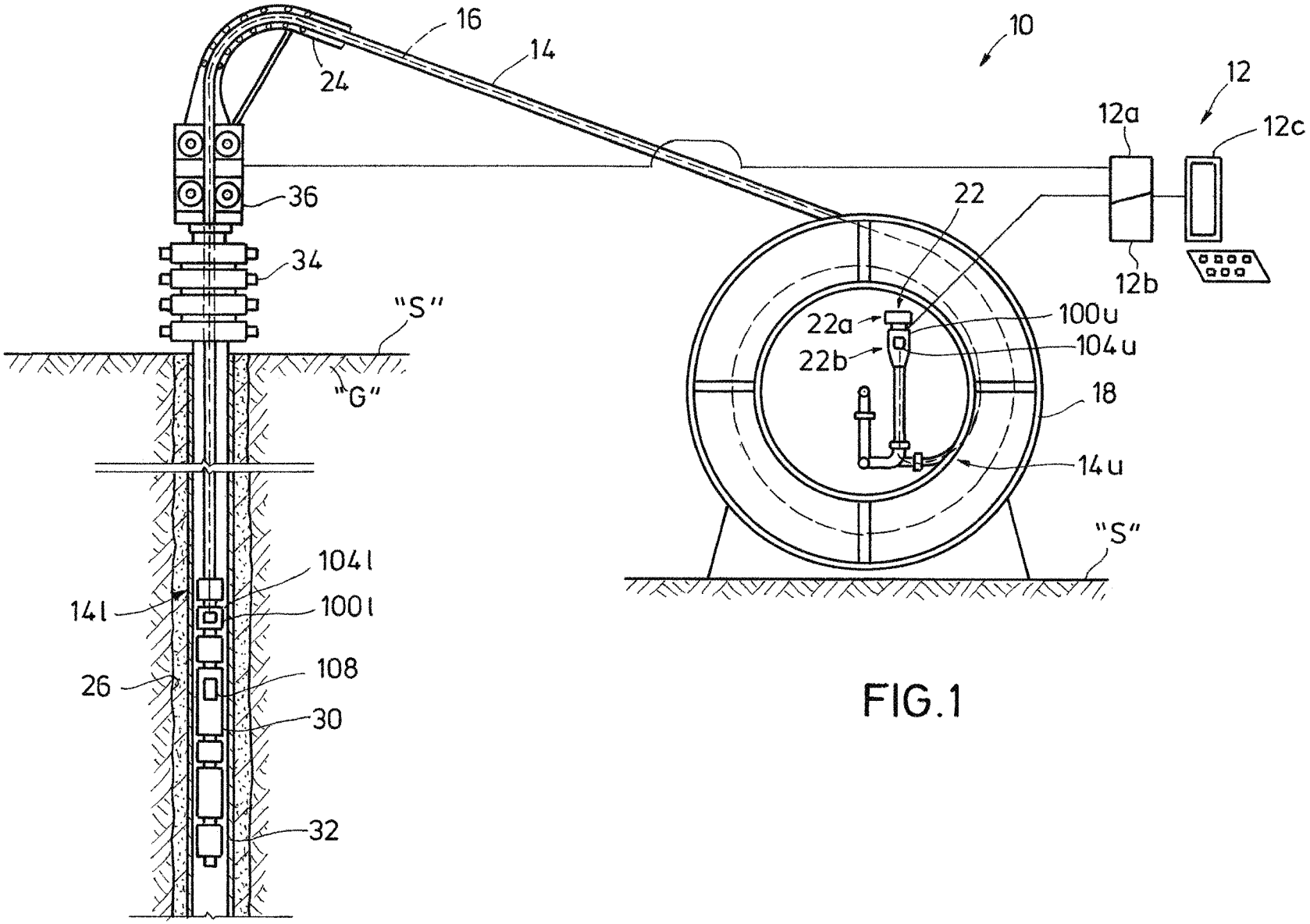
FIG. 1 is a partially cross-sectional side view of a coiled tubing system including a data acquisition system for monitoring forces applied to a signal cable extending through a coiled tubing strand in accordance with one or more exemplary embodiments of the disclosure.

FIG. 1 is a partially cross-sectional side view of a coiled tubing system 10 including a data acquisition system 12 in accordance with exemplary embodiments of the present disclosure. The coiled tubing system 10 is operable to perform coiled tubing operations, such as well maintenance, well intervention, and drilling. The data acquisition system 12 may be operable to provide real time corrective action and/or feedback to an operator regarding these operations as described in greater detail below. The system 10 includes a coiled tubing strand 14 and a signal cable 16 extending therethrough. In some example embodiments, the signal cable 16 comprises an armored optical cable operable to transmit photo-optic signals therethrough. In other embodiments, the signal cable may additionally or alternatively operate to transmit electrical power and or data signals as appreciated by those skilled in the art. The coiled tubing strand 14 and the signal cable 16 are wound together around a spool 18, which facilitates storage, transportation and deployment of the coiled tubing strand 14 and signal cable 16. An upper end 14*u* of the coiled tubing strand 14 is coupled to a reel termination assembly 22, which may be configured to permit fluids to be pumped through the coiled tubing strand 14 with the signal cable 16 therein as the spool 18 is rotated. The reel termination assembly 22 includes a fluid inlet 22*a* through which fluids may be pumped into and/or out of the coiled tubing strand 14. The reel termination assembly 22 also includes a bulkhead device 22*b* where an additional length of signal cable 16 may be inserted into the coiled tubing strand 14, or a length of the signal cable may be withdrawn from the coiled tubing strand e.g., when it is determined that undue forces are acting upon the signal cable 16 that could damage or disconnect the signal cable as described below. From the spool 18, the coiled tubing strand 14 extends over guide arch 24 into a wellbore 26 where a lower end 14*l* of the coiled tubing strand 14 is coupled to a downhole tool 30.

The wellbore 26 extends from a surface location "S" to a subterranean location within a geologic formation "G." In the illustrated example, a casing string 32 extends at least partially into the wellbore 26 and is cemented within the geologic formation "G". In other embodiments, the coiled tubing system 10 may be operated in connection with fully open-hole wellbores. A blowout preventer stack 34 is provided at the surface location "S," and may be automatically operable to seal the wellbore 26 in the event of an uncontrolled release of fluids from the wellbore 26. Also at the surface location, a tubing injector 36 is provided to selectively impart drive forces to the coiled tubing strand 14, e.g., to run the strand 14 into the wellbore 26 or to pull the strand 14 from the wellbore 26. The tubing injector 36, guide arch 24 and other equipment may be supported on a derrick (not shown), crane or similar other oilfield apparatus, as appreciated by those skilled in the art.

The signal cable 16 is attached to the lower end 14*l* of the coiled tubing strand 14 at a lower anchor assembly 100*l* and attached to the upper end 14*u* of the coiled tubing strand 14 at an upper anchor assembly 100*l*. As described in greater detail below, the lower and upper anchor assemblies 100*l*, 100*u* each include a respective detector element 104*l*, 104*u* therein that is operable to measure a force applied to the signal cable 14 at the respective anchor assembly 100*l*, 100*u*. The detector elements 104*l*, 104*u* are communicatively coupled to the data acquisition system 12 such that the data acquisition system 12 may evaluate whether the forces applied to the signal cable 14 at the respective anchor assemblies 100*l*, 100*u* are above or below respective first and second predetermined thresholds. The lower detector element 100*l* may be communicatively coupled to the data acquisition system 12 through the signal cable 16 and through a tool electronics package 108 in the downhole tool 30. For example, the lower detector element 104*l* may be communicatively coupled to the electronics package 108, and the electronics package 108 may be communicatively coupled to the data acquisition system 12 through the signal cable 16 (see FIG. 5) below. As described in greater detail below, this arrangement may protect the electronics package 108 from contamination during a rigging up procedure. The upper detector element 104*u* may be directly coupled to the data acquisition system 12 with a direct electrical connection.

The data acquisition system 12 may include a controller having a processor 12*a* and a computer readable medium 12*b* operably coupled thereto. In some exemplary embodiments, the controller may include a compact real-time input output (cRIO) system available from National Instruments Corporation. The computer readable medium 12*b* can include a nonvolatile or non-transitory memory with data and instructions that are accessible to the processor 12*a* and executable thereby. The computer readable medium 12*b* may also be pre-programmed or selectively programmable with a threshold associated with each of the detector elements 104*l*, 104*u* above which corrective action may be taken, e.g., to prevent damage or disconnection of the signal cable 16. In some embodiments, the controller processor 12*a* may be operatively coupled to the tubing injector 36 such that the processor 12*a* may automatically instruct the tubing injector 36 to interrupt driving the coiled tubing strand 14 into the wellbore 26 when the threshold associated with at least one of the detector elements 104*l*, 104*u* is exceeded, for example.

Alternatively or additionally, the processor 12*a* may be optionally coupled to a desktop computer 12*c* having a display, or another computing device which may receive data from multiple sources. In some embodiments, the desktop computer 12*c* may receive signals indicative of the forces detected by each of detector elements 104*l*, 104*u* from the processor 12*a* for storage and/or comparison with the appropriate threshold. In one or more embodiments, the computer readable medium 12*b* and/or the desktop computer 12*c* is pre-programmed with a sequence of instructions that will cause the display of the desktop computer 12*c* to provide an indication of the forces detected by each of detector elements 104*l*, 104*u*. The forces detected by each of detector elements 104*l*, 104*u* may be stored locally on the controller computer readable medium 12*b* and/or by the desktop computer 12*c* throughout a wellbore operation, whether or not the predetermined thresholds are exceeded.

Figure 2:
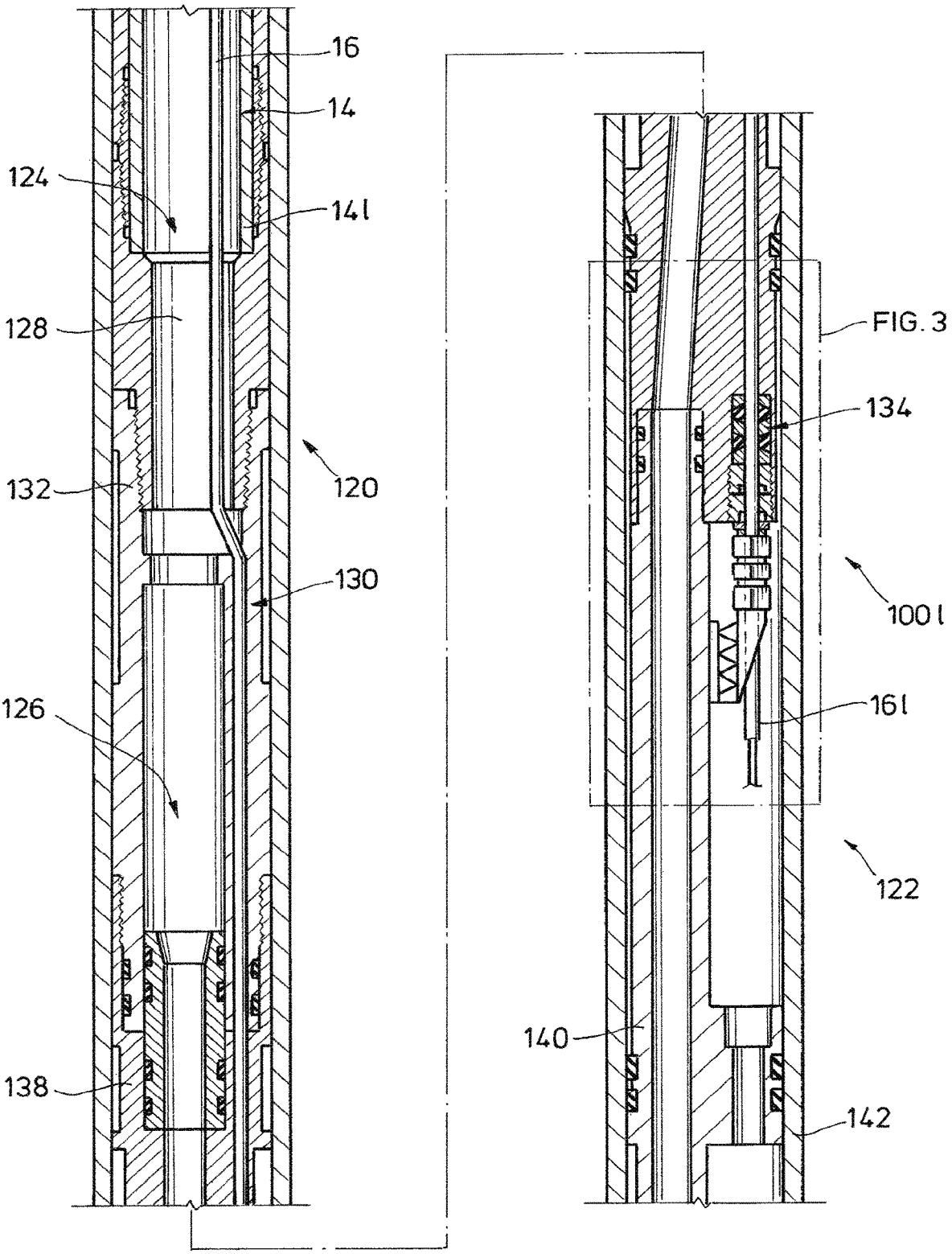
FIG. 2 is a partial, cross-sectional side view of an anchor assembly for connecting an end of the signal cable to an end of the coiled tubing strand.

FIG. 2 is a partial, cross-sectional side view of the lower anchor assembly 100*l* for connecting the lower end 16*l* of the signal cable 16 to the lower end 14*l* of the coiled tubing strand 14. The lower anchor assembly 100*l* generally includes a double-slip connector 120 that grips the lower end 14*l* of the coiled tubing strand 14, and an anchor sub 122 that grips the lower end 16*l* of the signal cable 16. The coiled tubing strand 14 includes an interior passageway 124, through which the signal cable 16 extends. The interior passageway 124 is in fluid communication with a flow passage 126 that extends through the double slip connector 120 and the anchor sub 122. As recognized in the art, fluids may be communicated into and out of the wellbore 26 (FIG. 1) through the interior passageway 124 and flow passage 126.

The signal cable 16 extends within the flow passage 126 through a first component 128 of the double slip connector 120, and within a distinct cable passage 130 through a second component 132 of the double slip connector 120. The distinct cable passage 130 may be fluid communication with the flow passage 126 to facilitate a transition of the signal cable between the flow passage 126 and the cable passage 130. Thus, a fluid seal 134 may be provided within the cable passage 130 to protect electronic equipment within the anchor assembly 100*l* and/or downhole tool 30 (FIG. 1).

The anchor sub 122 includes a core member 138 and a flow tube 140 through which the flow passage 126 extends. The cable passage 130 extends through the core member 138 and terminates on an exterior of the flow tube 140. The core member 138 and the flow tube 140 may be fixedly coupled to one another and also fixedly coupled to the double slip connector 120 by threads, welding or other connection mechanisms recognized in the art. An outer housing 142 may be provided around one or more of the first and second components 128, 130 of the double slip connector 120, the core member 138 and flow tube 140 of the anchor sub 122. At least a portion of the outer housing 142 may be removable to facilitate connection of the signal cable 16 to the anchor sub 122 and any other process for rigging up the downhole tool 30 (FIG. 1).

Figure 3:
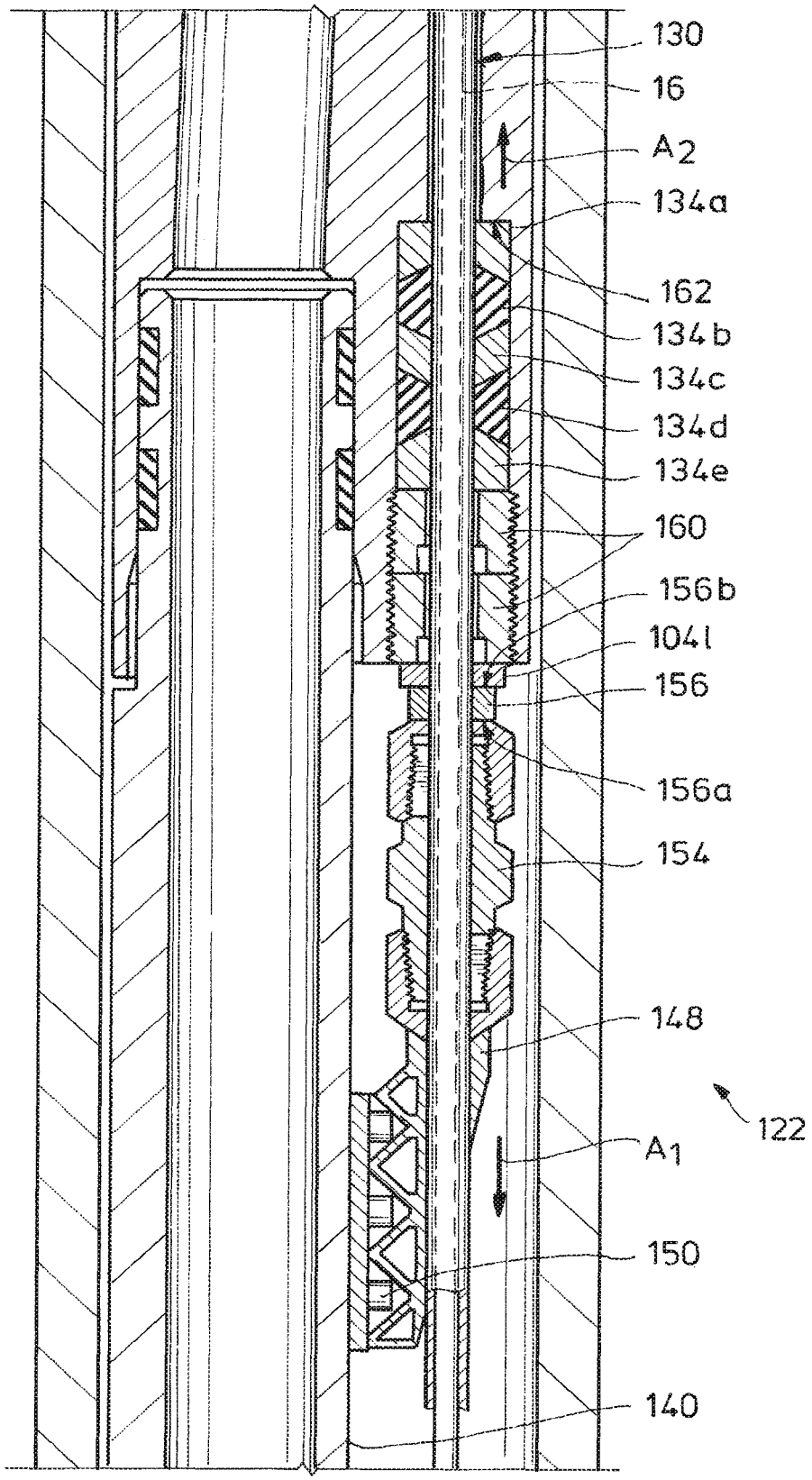
FIG. 3 is an enlarged view of the area of interest identified in FIG. 2 illustrating an anchor sub including a load cell for detecting a force applied to the signal cable.

FIG. 3 is an enlarged view of the area of interest identified in FIG. 2 illustrating the lower detector element **104*l* installed within the lower anchor sub 122. The anchor sub 122 includes a compressive anchor 148, which may be fixedly coupled to an outer surface of the flow tube 140 with fasteners 150. The fasteners 150 maintain the compressive anchor 148 a longitudinal position along the anchor sub 122. A double swage anchor 154 is provided adjacent the compressive anchor 148 for engaging the signal cable 16. The double swage anchor 154 may be plastically deformed surrounding the signal cable 16 to securely grip the signal cable 16. The engagement of the double swage anchor 154 with the compressive anchor 148 prohibits longitudinal movement of the signal cable 16** in the direction of arrow $A_1$.

A load washer 156 is provided adjacent the double swage anchor 154 opposite the compressive anchor 148. The load washer 156 has a first profile **156*a* on a first longitudinal end corresponding to the double swage anchor 154 and second profile 156*b* on a second longitudinal end corresponding to the lower detector element 104*l*. The load washer 156 thus facilitates the distribution of forces applied to the double swage anchor 154 to the lower detector element 104*l*. Adjacent the lower detector element 104*l* and opposite load washer 156 is a pair of seal nuts 160 threaded into the core member 138 of the anchor sub 122. The seal nuts 160 are threaded to a longitudinal position in which the fluid seal 134 is compressed in the direction of arrow A.sub.2 against a shoulder 162 defined in the cable passage 130. In some embodiments, the fluid seal 134 includes a plurality of alternating convex and concave seal members 134*a*, 134*b*, 134*c*, 134*d*, 134*e*, which cooperate to engage the core member 130 under the compressive force of the seal nuts 160, and thereby seal the cable passage 130**.

When the anchor sub 122 is fully assembled, a predetermined compressive preload may be applied to the lower detector element **104*l*. The longitudinal positions of the compressive anchor 148 and the seal nuts 160 may be selected such that the lower detector element 104*l* is compressed between the load washer 156 and the seal nuts 160. Where the lower detector element 104*l* is a load cell, the load cell may measure the compressive preload, which defines a baseline force applied to the load cell. When a tensile force is applied to the signal cable 16, e.g., in the direction of arrow $A_2$, the signal cable 16 pulls the double swage anchor 154 and load washer 156 in the direction of arrow $A_2$, and further compresses the lower detector element 104*l*. Similarly, when a compressive force is applied to the signal cable, e.g., in the direction of arrow $A_1$, the signal cable 16 urges the double swage anchor 154 in the direction of arrow $A_1$, thus permitting at least a portion of the predetermined compressive preload to be relieved. The forces measured by the lower detector element 104*l*** may be compared to the predetermined compressive preload to determine the tensile or compressive force applied to the signal cable.

The upper detector element **104*u* (FIG. 1) may be similarly preloaded in the upper anchor assembly 100*u* (FIG. 1). For example, the upper detector element 104*u* may be supported in compression between seal nuts 160 on a first side thereof and a load washer 156, double swage anchor 156 coupled to the upper end 16*u* of the signal cable, and a compressive anchor 148** on an opposite side thereof.

Figure 4:
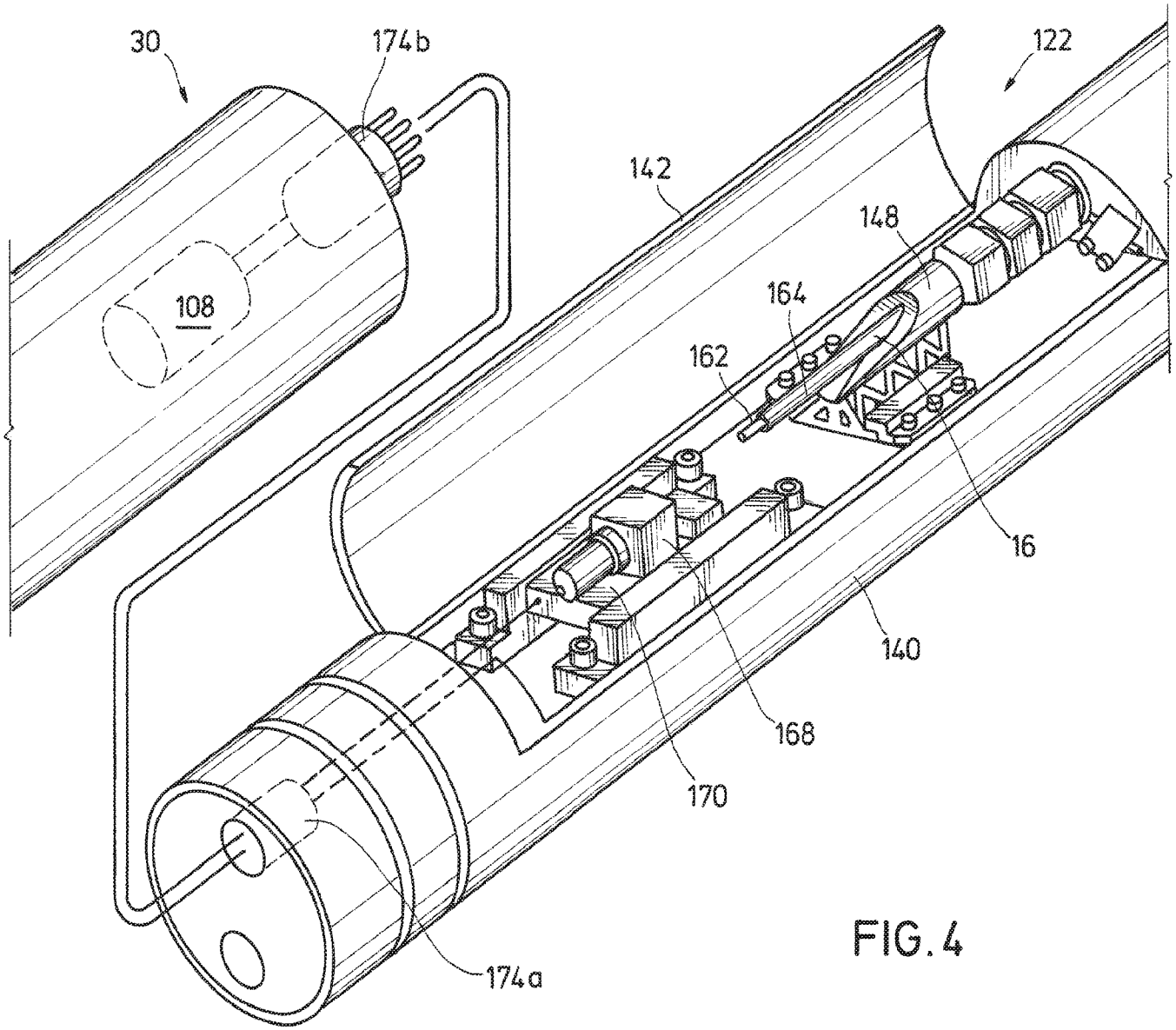
FIG. 4 is a partial perspective view of a connection between the anchor sub of FIG. 3 and a downhole tool in accordance with aspects of the present disclosure.

Referring to FIG. 4, a partial perspective view of a connection between the anchor sub 122 and the downhole tool 30 is illustrated. The lower end **16*l* of the signal cable 16 is secured within the anchor sub 122 with the double swage anchor 156 and compressive anchor 148 as described above. In some example embodiments, the signal cable 16 comprises a fiber-optic strand 162 extending through an armored casing 164. The fiber optic strand 162 may be optically coupled to a light emitter 168 and/or light receiver (not shown) supported within the anchor sub 122. The light emitter 168 and/or light receiver may be operably associated with a light controller 170 or other electronics package for encoding and/or decoding optic signals transmitted or to be transmitted through the signal cable 16. The light controller 170 may be enclosed and sealed within the anchor sub 122 by the outer housing 142. As indicated above, a portion of the outer housing 142 may be removable to expose the light emitter 168 and the lower end 16*l* of the signal cable 16 to facilitate anchoring the signal cable 16 within the anchor sub 122 and/or "rigging up" the downhole tool 30**.

The light controller 170 may be communicatively coupled to the electronics package 108 of the downhole tool 30 by conventional electrical conductors. In some embodiments, corresponding electrical connectors **174*a*, 174*b* are respectively provided between the anchor sub 122 and the downhole tool 30 to facilitate the connection. The lower detector element 104*l* may be similarly coupled to the tool electronics package 108 through conventional electrical conductors and the electrical connectors 174*a*, 174*b*. Generally, measurements made by the lower detector element 104*l* may be electrically transmitted to the electronics package 108, which may, in turn, electrically transmit the measurements to the light controller 170. The light controller 170 may then instruct the light emitter 168 to provide a signal indicative of the measurements for optic transmission through the signal cable 16 to the data acquisition system 12 (FIG. 1**).

Since the light emitter 168 and light controller 170 are disposed within the anchor sub 122 and are separate from the electronics package 108 of the downhole tool 30, the arrangement depicted in FIG. 4, permits communicatively coupling the signal cable 16 to the downhole tool without exposing the electronics package 108 of the downhole tool 30 to the ambient environment. The electronics package 108 may thus be protected from contamination during "rigging up" procedures, which may often be performed at a well site where cleanliness is often impractical due to external factors such as wind, dust, snow, rain, etc.

Figure 5:
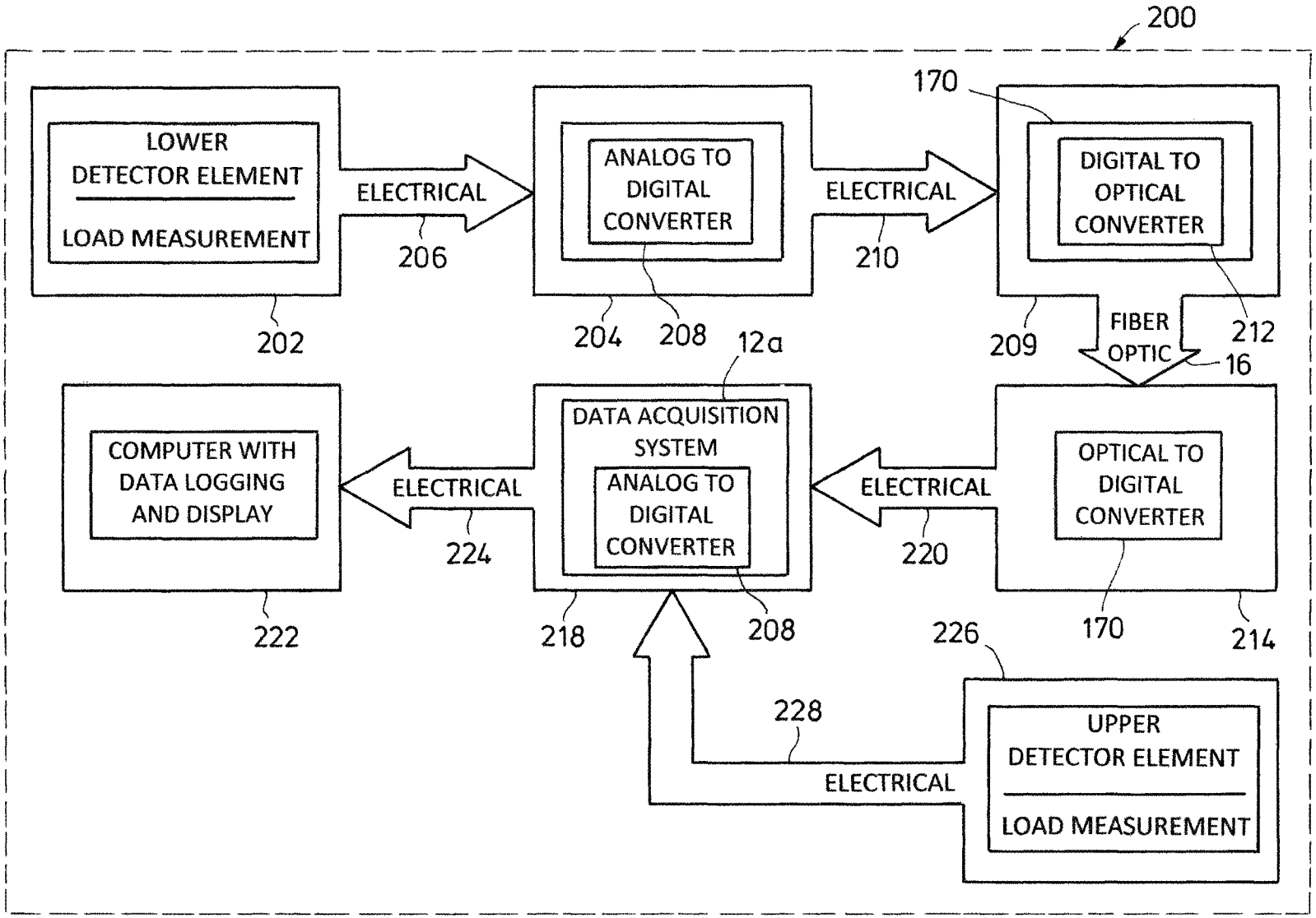
FIG. 5 is a schematic view of a communication network of the coiled tubing system of FIG. 1.

FIG. 5 is a schematic view of a communication network 200 of the coiled tubing system 10. At a downhole location 202, the lower detector element **104*l* may make measurements of a first force applied to the signal cable 16. The lower detector element 104*l* may generate an analog signal that is transmissible to a downhole location 204 by an electrical pathway 206. At the downhole location 204, the analog signal may be received by an analog to digital converter 208, which may be a component of the electronics package 108 of the downhole tool 30. The electrical pathway 206 may include the electrical connectors 174*a*, 174*b*** (FIG.

4) communicatively coupling the anchor assembly 122 to the downhole tool 30. The analog to digital converter 208 is operable to convert the analog signal of the measurements to a digital signal, which may be transmitted to a downhole location 209 through an electrical pathway 210. At the downhole location 209, the digital signal of the measurements may be received by a digital to optical converter 212, which may be a component of the light controller 170 coupled to the anchor assembly 122. The electrical pathway 210 may also include the electrical connectors 174*a*, 174*b* that communicatively couple the anchor assembly 122 the downhole tool 30. The digital to optical converter 212 is operable to convert the digital signal of the measurements to an optical signal, which may be transmitted up-hole through the signal cable 16.

The signal cable 16 may transmit the optical signal of the measurements uphole to a surface location 214. At the surface location 214, the optical signal may be received by an optical to digital converter 216 within the reel termination assembly 22 (FIG. 1). The optical to digital converter 216 may be a component of a light controller 170 coupled in the upper anchor assembly 100*u*. The optical to digital converter 216 is operable to convert the optical signal of the measurements to a digital signal, which is transmissible to a surface location 218 by an electrical pathway 220. At the surface location 218, the signal may be received by the processor 12*a* of the data acquisition system 12. The processor 12*a* may be operable to assess the measurements of the first force and to identify a recommendation for corrective action (or no corrective action) based on the signal indicative of forces measured by the lower detector element 104*l*. A signal indicative of the recommendation may be generated by the processor 12*a* and transmitted to a surface location 222 through an electrical pathway 224. At the surface location 222, the signal representative of the recommendation may be received by the display 12*c* of the data acquisition system, from which a user (not shown) may receive the recommendation.

At a surface location 226, the upper detector element 104*u* may make measurements of a second force applied to the signal cable 16. The upper detector element 104*u* may generate an analog signal that is transmissible to the surface location 218 by an electrical pathway 228. At the surface location 202, the analog signal may be received by an analog to digital converter 208, which may be a component of the processor 12*a*. The processor 12*a* may assess the measurements of the first and second forces together, and provide a recommendation for corrective action based on the assessment. The recommendation may be transmitted to the display 12*c* of the data acquisition system 12 as described above.

2. Example Methods of Operation

Figure 6:
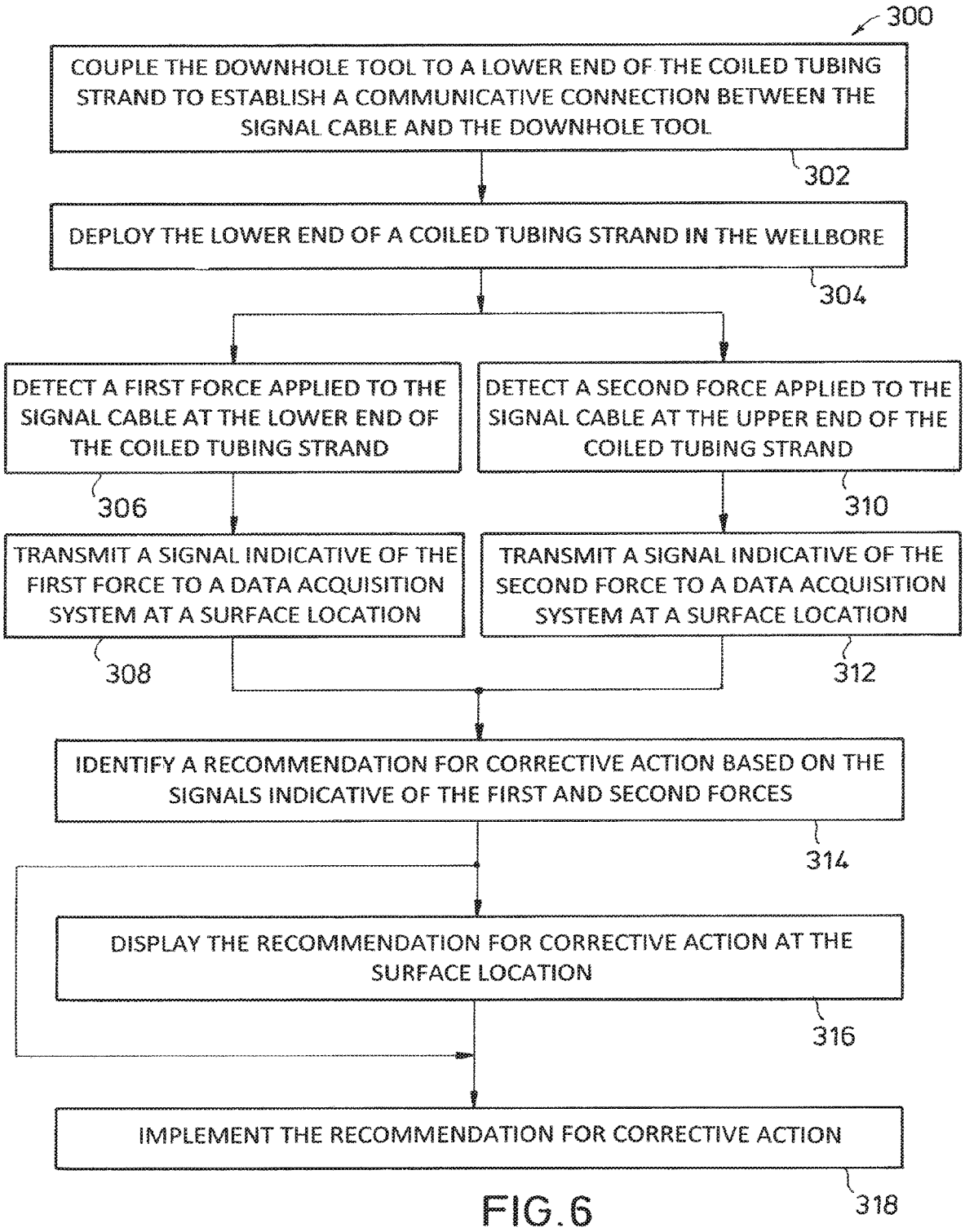
FIG. 6 is a flowchart illustrating an operational procedure for deploying and operating the coiled tubing system of FIG. 1 in accordance with one or more exemplary embodiments of the disclosure.

FIG. 6 is a flowchart illustrating at least a portion of an operational procedure 300 for deploying and operating the coiled tubing system 10 (FIG. 1). With reference to FIG. 6 and continued reference to FIGS. 1 through 5, the procedure 300 begins initially at step 302 where the downhole tool 30 may be assembled to the lower end 14*l* of the coiled tubing strand 14. In some embodiments, this initial step may include removing a portion of the outer housing 142 of the lower anchor assembly 100*l* and anchoring the lower end 16*l* of the signal cable 16 within the anchor sub 122. An appropriate amount of slack may be provided in the signal cable 16 to accommodate the expected differences in elongation between the signal cable 16 and coiled tubing strand 14. The outer housing 142 may be replaced, and the corresponding electrical connectors 174*a*, 174*b* may be coupled to one another to establish a communicative connection between the signal cable 16 and the downhole tool 30. The electronics package 180 of the downhole tool may remain sealed within a housing of the downhole tool 30 throughout this initial step 302 such that the tool electronics package 180 may remain fluidly from the light emitter 168 and light controller, and remain protected from contamination at a well site.

Next, at step 304, the lower end 14*l* of the coiled tubing strand 14 may be deployed into the wellbore 26. The downhole tool 30 may be lowered into the wellbore 26 from the surface location "S" by uncoiling the tubing strand 14 from the spool 18 in a conventional manner. At step 306, a first force applied to the lower end 16*l* of the signal cable 16 is detected and measured by the lower detector element 104*l*, and at step 308 a signal indicative of the first force is transmitted to the data acquisition system 12 at the surface location "S." The signal indicative of the first force may be transmitted through the electronics package 180 of the downhole tool 30 and then through the signal cable 16. A second force applied to the upper end 16*u* of the signal cable may detected and transmitted to the surface location at steps 310 and 312 concurrently with steps 306 and 308.

At step 314, the data acquisition system 12 may assess the signals indicative of the first and second forces and identify a recommendation for any corrective action. In some embodiments, the data acquisition system 12 assesses whether the first and second forces are above or below respective first and second predetermined thresholds stored on a memory 12*b* of the data acquisition system 12. The thresholds may be established to define a force in which the signal cable 16 may operate effectively. For example, the thresholds may define a force at which the signal cable 16 may be damaged or may become disconnected from the respective upper and lower anchor assemblies 100*l*, 100*u*. The recommendation may be displayed on the display of the data acquisition at step 316. An indication of the first and second forces may also be displayed, and an alarm may be provided if the first and second forces exceed the appropriate predetermined threshold.

At step 318, an operator at the surface location "S" may implement the recommendation for corrective action. For example, the operator may deploy an additional length of signal cable 16 into the upper end 14*u* of the coiled tubing strand 14 based on the recommendation for corrective action when the first or second force exceeds a predetermined tensile or compressive threshold. In this manner, the communication through the signal cable 16 may be maintained throughout the wellbore operation.

In some example embodiments, the procedure 300 may proceed directly from step 314 to step 318. For example, the processor 12*b* may provide instructions to the tubing injector 36 to automatically implement the recommendation for corrective action without displaying the recommendation to an operator at step 316 or requiring any action on the part of the operator. For example, the processor 12*b* may instruct the tubing injector to automatically cease imparting forces to the coiled tubing strand 14 when a threshold is exceeded, and then if necessary a recommendation for further corrective action may be displayed for consideration by an operator.

3. Aspects of the Disclosure

The aspects of the disclosure described in this section are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to a coiled tubing apparatus. The coiled tubing apparatus includes a coiled tubing strand defining lower end and an upper end and a signal cable disposed within the coiled tubing strand. The signal cable is attached to the lower end of the coiled tubing strand at a lower anchor assembly and attached to the upper end of the coiled tubing strand at an upper anchor assembly. A lower detector element is provided in the lower anchor assembly and is operable to measure a first force applied to the signal cable at the lower anchor assembly. An upper detector element is provided in the upper anchor assembly and is operable to measure a second force applied to the signal cable at the upper anchor assembly.

In one or more example embodiments, the upper detector element and the lower detector element each comprise a load cell operable to measure at least one of a tensile force and a compressive applied to the signal cable. In some embodiments, a compressive preload is applied to the load cells such that compressive first and second forces applied to the signal cable relieves at least a portion of the compressive preload. At least one of the upper and lower anchor assemblies may further include a compressive anchor affixed to a core of the anchor assembly and a lock mechanism affixed to the signal cable, and the compressive anchor may prevent the lock mechanism from moving away from the load cell.

In some embodiments, the signal cable includes a fiber optic communication cable, and the lower anchor assembly further includes a light emitter in optic communication with the fiber optic communication cable. A light controller carried by the lower anchor assembly may be operably coupled the light emitter. In some embodiments, the light controller is selectively connectable to a downhole tool by an electrical connection established with the anchor assembly.

In another aspect, the disclosure is directed to a coiled tubing system for wellbore operations. The system includes a coiled tubing strand defining a lower end and an upper end. A signal cable extends through the coiled tubing strand between the lower end and the upper end. A lower detector element is operable to measure a first force applied to the signal cable at the lower end and an upper detector element is operable to measure a second force applied to the signal cable at the upper end. The system also includes a data acquisition system operably coupled to both the upper and lower detector elements. The data acquisition system is operable to provide an indication of whether the first and second forces are above or below respective first and second predetermined thresholds stored on a memory of the data acquisition system.

In exemplary embodiments, the wellbore system further includes a downhole tool coupled to the lower end of the coiled tubing strand and communicatively coupled to the lower detector element. The lower detector element may be operably coupled to the data acquisition system through the downhole tool and the signal cable. The signal cable may include a fiber optic cable, and a lower end of the fiber optic cable may terminate within a lower anchor assembly coupled between the lower end of the coiled tubing strand and the downhole tool. In some embodiments, the lower anchor assembly further comprises a light emitter in optical communication with the fiber optic cable, and the downhole tool may further include a tool electronics package communicatively coupled to both the light emitter and the lower detector element. The light emitter and the tool electronics package may be fluidly isolated from one another. In some embodiments, an upper end of the fiber optic cable terminates within an upper anchor assembly coupled to a reel termination assembly configured to enable fluids to be pumped into the coiled tubing strand while permitting a spool supporting the coiled tubing strand to rotate.

In one or more exemplary embodiments, the upper detector element includes a load cell coupled to the data acquisition system through a direct electrical connection. The data acquisition system may be operable to provide a recommendation for corrective action based on detecting the first or second force above the respective first and second predetermined thresholds.

In another aspect, the disclosure is directed to a method of deploying a coiled tubing apparatus into a wellbore. The method includes (a) deploying a lower end of a coiled tubing strand into the wellbore, the lower end of the coiled tubing strand attached to a signal cable extending though the coiled tubing strand, (b) detecting a first force applied to the signal cable at the lower end of the coiled tubing strand within the wellbore, (c) transmitting a signal indicative of the first force to a data acquisition system disposed at a surface location, (d) detecting a second force applied to the signal cable at an upper end of the coiled tubing strand disposed at the surface location, (e) transmitting a signal indicative of the second force to the data acquisition system, (f) identifying, with the data acquisition system, a recommendation for corrective action based on the signals indicative of the first and second forces, and (g) displaying the recommendation for corrective action at the surface location.

In some embodiments, the method further includes deploying an additional length of signal cable into the upper end of the coiled tubing strand based on the recommendation for corrective action when the second force exceeds a predetermined tensile threshold. In some embodiments, the method further includes transmitting the signal indicative of the first force to the to the data acquisition system through the signal cable.

In one or more embodiments, the method further includes coupling a downhole tool to the lower end of the coiled tubing strand to thereby establish a communicative connection between the signal cable and the downhole tool. Establishing a communicative connection between the signal cable and the downhole tool may further include coupling an electrical connector carried by the downhole tool to a corresponding electrical connector carried by the lower end of the coiled tubing strand. Transmitting the signal indicative of the first force may include transmitting an electrical signal through the electrical connectors and transmitting an optical signal through the signal cable.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A coiled tubing apparatus comprising:

a coiled tubing strand defining lower end and an upper end;

a signal cable disposed within the coiled tubing strand, the signal cable attached to the lower end of the coiled tubing strand at a lower anchor assembly and attached to the upper end of the coiled tubing strand at an upper anchor assembly, wherein the signal cable comprises a fiber optic communication cable and wherein the lower anchor assembly further comprises a light emitter in optic communication with the fiber optic communication cable and a light controller operably coupled the light emitter;

a lower detector element operable to measure a first force applied to the signal cable at the lower anchor assembly; and an upper detector element operable to measure a second force applied to the signal cable at the upper anchor assembly.

2. The apparatus of claim 1, wherein the upper detector element and the lower detector element each comprise a load cell operable to measure at least one of a tensile force and a compressive force applied to the signal cable.

3. The apparatus of claim 2, wherein at least one of the load cells of the upper and lower detector elements is longitudinally arranged between a compressive anchor and a shoulder, and wherein the longitudinal position of the compressive anchor with respect to the shoulder is selected to apply a compressive preload to the at least one of the load calls to permit compressive first and second forces applied to the signal cable to relieve at least a portion of the compressive preload.

4. The apparatus of claim 3, further comprising a lock mechanism affixed to the signal cable and longitudinally positioned between the compressive anchor and the load cell.

5. The apparatus of claim 3, further comprising a load washer adjacent the load cell and a longitudinally arranged between the compressive anchor and the load cell.

6. The apparatus of claim 1, wherein the light controller is selectively connectable to a downhole tool by an electrical connection established with the anchor assembly.

7. The apparatus of claim 1, wherein the lower anchor assembly includes a compressive anchor that prohibits longitudinal movement of the signal cable along the coiled tubing strand.

8. A coiled tubing system for wellbore operations, the system comprising:

a coiled tubing strand defining a lower end and an upper end;

a signal cable extending through the coiled tubing strand between the lower end and the upper end;

a lower detector element operable to measure a first force applied to the signal cable at the lower end;

an upper detector element operable to measure a second force applied to the signal cable at the upper end;

a data acquisition system operably coupled to both the upper and lower detector elements, the data acquisition system operable to provide an indication of whether the first and second forces are above or below respective first and second predetermined thresholds stored on a memory of the data acquisition system;

a downhole tool coupled to the lower end of the coiled tubing strand and communicatively coupled to the lower detector element, the lower detector element operably coupled to the data acquisition system through the downhole tool and the signal cable; and a lower anchor assembly coupled between the lower end of the coiled tubing strand and the downhole tool, wherein the signal cable comprises a fiber optic cable and wherein a lower end of the fiber optic cable terminates within the lower anchor assembly, and wherein the lower anchor assembly further comprises a light emitter in optical communication with the fiber optic cable, wherein the downhole tool further comprises a tool electronics package communicatively coupled to both the light emitter and the lower detector element.

9. The wellbore system of claim 8, wherein the light emitter and the tool electronics package are fluidly isolated from one another.

10. The wellbore system of claim 8, wherein an upper end of the fiber optic cable terminates within an upper anchor assembly coupled to a reel termination assembly configured to enable fluids to be pumped into the coiled tubing strand while permitting a spool supporting the coiled tubing strand to rotate.

11. The wellbore system of claim 8, wherein the upper detector element comprises a load cell coupled to the data acquisition system through a direct electrical connection.

12. The wellbore system of claim 8, wherein the data acquisition system is operable to provide a recommendation for corrective action based on detecting the first or second force above the respective first and second predetermined thresholds.

13. The wellbore system of claim 8, wherein the lower anchor assembly includes a compressive anchor that prohibits longitudinal movement of the signal cable along the coiled tubing strand.

14. A method of deploying a coiled tubing apparatus into a wellbore, the method comprising:

coupling a downhole tool to a lower end of a coiled tubing strand to thereby establish a communicative connection between the downhole tool and a signal cable extending though the coiled tubing strand, wherein the communicative connection includes an optical connection between a fiber optic cable of the signal cable and a light emitter of a lower anchor assembly coupling a lower end of the signal cable to the lower end of the coiled tubing strand;

deploying the lower end of the coiled tubing strand and the downhole tool into the wellbore;

detecting a first force applied to the signal cable at the lower end of the coiled tubing strand within the wellbore;

transmitting a signal indicative of the first force to a data acquisition system disposed at a surface location;

detecting a second force applied to the signal cable at an upper end of the coiled tubing strand disposed at the surface location;

transmitting a signal indicative of the second force to the data acquisition system;

identifying, with the data acquisition system, a recommendation for corrective action based on the signals indicative of the first and second forces; and displaying the recommendation for corrective action at the surface location.

15. The method of claim 14, further comprising deploying an additional length of signal cable into the upper end of the coiled tubing strand based on the recommendation for corrective action when either the first force or the second force exceeds a predetermined tensile threshold.

16. The method of claim 14, further comprising transmitting the signal indicative of the first force to the to the data acquisition system through the signal cable.

17. The method of claim 14, wherein establishing a communicative connection between the signal cable and the downhole tool further comprises coupling an electrical connector carried by the downhole tool to a corresponding electrical connector carried by the lower end of the coiled tubing strand.

18. The method of claim 17, wherein transmitting the signal indicative of the first force comprises transmitting an electrical signal through the electrical connectors.

19. The method of claim 14, further comprising maintaining a tool electronics package of the downhole tool fluidly isolated from the light emitter while coupling the downhole tool to the lower end of the coiled tubing strand.

20. The method of claim 14, wherein transmitting the signal indicative of the first force further comprises transmitting an optical signal from the light emitter through the signal cable.

* * * * *